US009053898B2

(12) United States Patent
Kraft et al.

(10) Patent No.: US 9,053,898 B2
(45) Date of Patent: Jun. 9, 2015

(54) BRAZED X-RAY TUBE ANODE

(71) Applicant: KONINKLIJKE PHILIPS B.V., Eindhoven (NL)

(72) Inventors: Kevin Charles Kraft, Plainfield, IL (US); Ming-Wei Paul Xu, Oswego, IL (US); Min He, Downers Grove, IL (US); Gerald James Carlson, Aurora, IL (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/368,846

(22) PCT Filed: Dec. 21, 2012

(86) PCT No.: PCT/IB2012/057584

§ 371 (c)(1),
(2) Date: Jun. 26, 2014

(87) PCT Pub. No.: WO2013/098733

PCT Pub. Date: Jul. 4, 2013

(65) Prior Publication Data

US 2014/0355742 A1 Dec. 4, 2014

Related U.S. Application Data

(60) Provisional application No. 61/581,678, filed on Dec. 30, 2011.

(51) Int. Cl.

| | |
|---|---|
| ***H01J 35/10*** | (2006.01) |
| ***H01J 35/08*** | (2006.01) |
| ***H01J 9/18*** | (2006.01) |

(52) U.S. Cl.

CPC ..... *H01J 35/105* (2013.01); *H01J 2235/081* (2013.01); *H01J 35/108* (2013.01); *H01J 2235/084* (2013.01); *H01J 9/18* (2013.01)

(58) Field of Classification Search

CPC ..... H01J 35/08; H01J 35/10; H01J 35/105; H01J 35/108; H01J 2235/081; H01J 2235/083; H01J 2235/084; H01J 2235/085; H01J 2235/088

USPC ..... 378/119, 121, 125, 127–129, 141–144

See application file for complete search history.

(56) References Cited

U.S. PATENT DOCUMENTS

| | | | | |
|---|---|---|---|---|
| 4,597,095 | A | | 6/1986 | Akpan |
| 4,689,810 | A | * | 8/1987 | Devine, Jr. ..... 378/144 |
| 4,777,643 | A | | 10/1988 | Devine, Jr. |
| 4,978,051 | A | | 12/1990 | Tiearney, Jr. et al. |
| 5,155,755 | A | | 10/1992 | Penato et al. |
| 5,178,316 | A | | 1/1993 | Block |
| 5,204,891 | A | * | 4/1993 | Woodruff et al. ..... 378/143 |
| 5,247,563 | A | | 9/1993 | Block et al. |
| 5,655,000 | A | | 8/1997 | Benz et al. |
| 6,421,423 | B1 | | 7/2002 | Warren |

(Continued)

*Primary Examiner* — Anastasia Midkiff

(57) ABSTRACT

A method (100) creates a braze joint (58) between an anode plate (52) and a piece of graphite (56) of an x-ray tube (38). The method (100) includes receiving (102) the anode plate (52) and the piece of graphite (56). A barrier layer (66) and a braze layer (62) are arranged (104, 106, 108) between the anode plate (52) and the piece of graphite (56), where the barrier layer (66) is between the piece of graphite (56) and the brazing layer (62). The barrier layer (66) is heated (110) with the braze layer (62) to create the braze joint (58) between the anode plate (52) and the piece of graphite (56).

22 Claims, 3 Drawing Sheets

(56) References Cited

U.S. PATENT DOCUMENTS

2010/0266102 A1* 10/2010 Lee et al. ..... 378/127
2011/0249803 A1* 10/2011 Drory ..... 378/125
2011/0305324 A1* 12/2011 Lee et al. ..... 378/121
2014/0020823 A1* 1/2014 Montross ..... 156/272.2

* cited by examiner

BRAZED X-RAY TUBE ANODE

CROSS-REFERENCE TO PRIOR APPLICATIONS

This application is the U.S. National Phase application under 35 U.S.C. §371 of International Application Serial No. PCT/IB2012/057584, filed on Dec. 21, 2012, which claims the benefit of U.S. Application Ser. No. 61/581,678, filed on Dec. 30, 2011. These applications are hereby incorporated by reference herein.

The present application relates generally to the x-ray tube art. It finds particular application in conjunction with rotating anode x-ray tubes and will be described with particular reference thereto. However, it is to be understood that it also finds application in other usage scenarios, and is not necessarily limited to the aforementioned application.

Conventional rotating anode x-ray tubes are made up of refractory metal targets, which have many favorable properties including high temperature, high strength, and good thermal conductivity and heat capacity. X-rays are generated by electron bombardment of the anode's focal track. A vast majority of energy applied to the focal spot and subsequent anode surface is transformed into heat, which must be managed. The localized heating of the focal spot, due to the electron bombardment, is a function of the target angle, focal track diameter, focal spot size (length×width), rotating frequency, power applied, and material properties (e.g., thermal conductivity, density, and specific heat). Focal spot temperatures and thermal-mechanical stresses are managed by controlling the above mentioned variables. However, in many cases, the x-ray tube protocols are limited due to the ability to modify these variables because of material property limitations.

The conventional rotating anode x-ray tube is often limited by the mechanical properties of the anode substrate material, as well as the ability of the material to remove the heat from a localized volume. X-ray anodes are typically manufactured with a substrate of molybdenum alloys, typically a titanium, zirconium, molybdenum (TZM) alloy, and a focal track consisting of a tungsten alloy, most likely 90-95% tungsten and 5-10% rhenium. These x-ray targets are also commonly brazed to a graphite back for additional heat storage capacity. However, this process of brazing the molybdenum substrate to the graphite piece introduces new issues. The elevated temperatures during the process of brazing recrystallize the substrate structure, thus decreasing the strength on the material itself. Additionally, this process of brazing also creates a brittle carbide layer with the braze alloy and graphite that can introduce an initiation point of delamination failure.

A common braze alloy used in x-ray anodes is titanium. This braze material is a good compromise of material strength and ductility of the braze joint. Titanium braze material has a braze temperature that preserves some strength of the substrate material (in comparison to some higher temperature braze materials), but also provides a good joint for high temperature application. However, titanium as a braze alloy has a strong affinity for carbide formation. This carbide continues to diffuse into a eutectic titanium (Ti)+titanium carbide (TiC) layer, which creates a layer of pure Ti, eutectic Ti+TiC, and TiC. During application and thermal cycling, the Ti portion in the eutectic Ti+TiC goes thru a $\alpha$-$\beta$ phase transformation. This transformation is also responsible for Ti volume change in the eutectic structure. In cycling back and forth between the $\alpha$ phase and $\beta$ phase, the volumetric changes of Ti create void formation in the eutectic layer, which is an initiation point for cracks. Once the cracks propagate to the brittle TiC layer, the anode is susceptible to the delamination failure mode.

The present application provides new and improved methods and systems which overcome the above-referenced problems and others.

In accordance with one aspect, a method creates a braze joint between an anode plate and a piece of graphite of an x-ray tube. The method includes receiving the anode plate and the piece of graphite. A barrier layer and a braze layer are arranged between the anode plate and the piece of graphite, where the barrier layer is between the piece of graphite and the brazing layer. The barrier layer is heated with the braze layer to create the braze joint between the anode plate and the piece of graphite.

In accordance with another aspect, an anode assembly of an x-ray tube is provided. The anode assembly includes an anode plate, a piece of carbon, and a braze joint between the anode plate and the piece of carbon. The braze joint includes a barrier layer and a braze layer between the anode plate and the piece of graphite, the barrier layer between the piece of graphite and the brazing material.

One advantage resides in a ductile braze joint suitable for managing stresses from cycling/creep/deformation.

Another advantage resides in a thicker pure titanium (Ti) layer (i.e., ductile layer).

Another advantage resides in elimination of the eutectic Ti+titanium carbide (TiC) layer which is subjected to void formation from phase transformation.

Another advantage resides in a decreased diffusion rate of carbon.

Another advantage resides in increased life of braze joint use application cycling.

Another advantage resides in elimination of the brittle TiC layer.

Still further advantages of the present invention will be appreciated to those of ordinary skill in the art upon reading and understanding the following detailed description.

The invention may take form in various components and arrangements of components, and in various steps and arrangements of steps. The drawings are only for purposes of illustrating the preferred embodiments and are not to be construed as limiting the invention.

Figure 1:
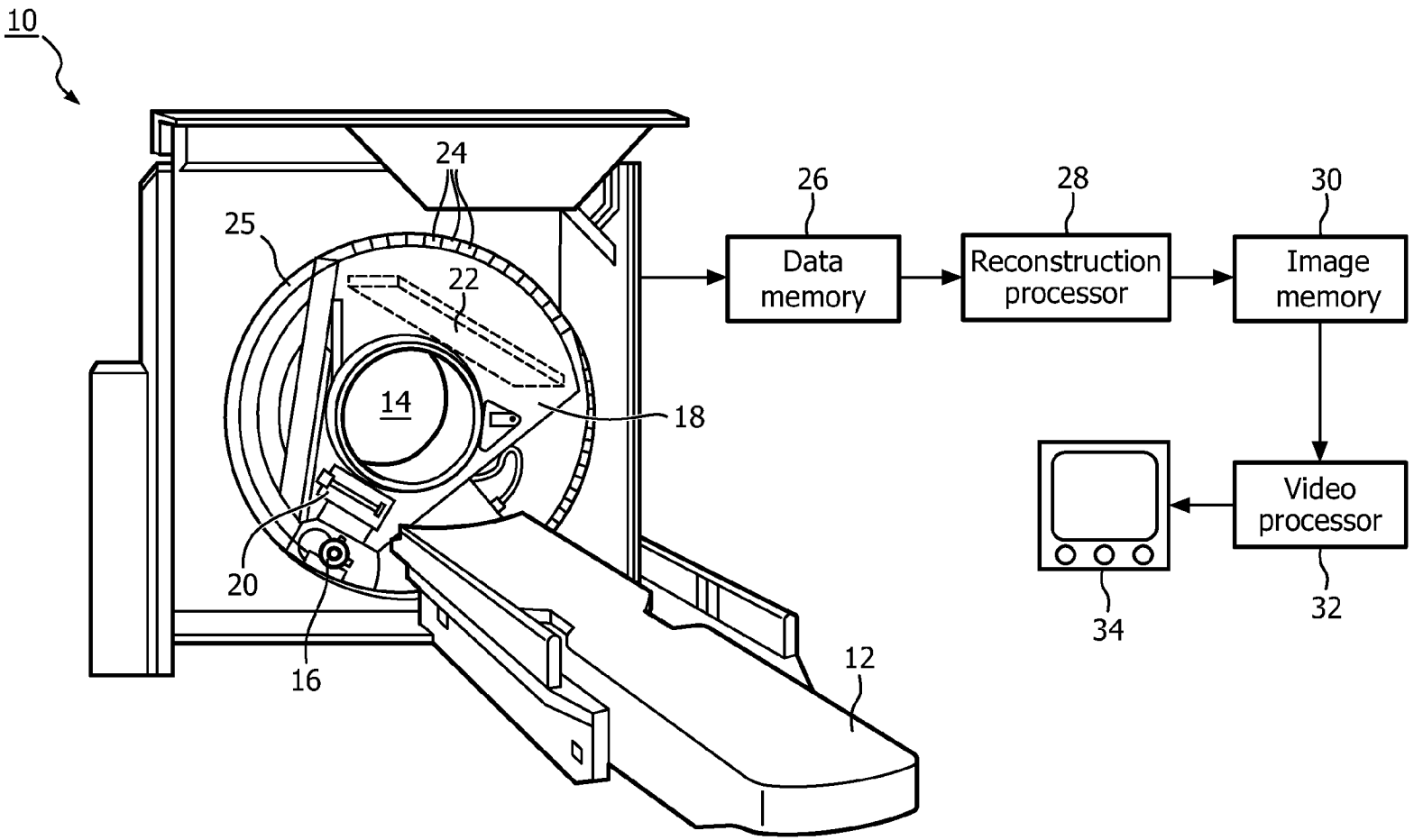
FIG. 1 is a diagrammatic illustration of a computerized tomography (CT) diagnostic system employing an x-ray tube assembly.

With reference to FIG. 1, a computerized tomographic (CT) scanner 10 radiographically examines and generates diagnostic images of a subject disposed on a patient support 12. More specifically, a volume of interest of the subject on the patient support 12 is moved into an examination region 14. An x-ray tube assembly 16 mounted on a rotating gantry 18 projects one or more beams of radiation through the examination region 14. A collimator 20 collimates the beams of radiation in one dimension. In third generation scanners, a two-dimensional x-ray detector 22 is disposed on the rotating gantry 18 across the examination region 14 from the x-ray tube assembly 16. In fourth generation scanners, a ring or array of two-dimensional detectors 24 is mounted on a stationary gantry 25 surrounding the rotating gantry 18.

Each of the two-dimensional x-ray detectors 20, 22 includes a two-dimensional array of photodetectors connected to or preferably integrated into an integrated circuit. The photodetectors generate electrical signals indicative of the intensity of the received radiation, which is indicative of the integrated x-ray absorption along the corresponding ray between the x-ray tube and the scintillation crystal segment.

The electrical signals, along with information on the angular position of the rotating gantry 18, are digitized by analog-to-digital converters. The digital diagnostic data is communicated to a data memory 26. The data from the data memory 26 is reconstructed by a reconstruction processor 28. Various known reconstruction techniques are contemplated including spiral and multi-slice scanning techniques, convolution and back projection techniques, cone beam reconstruction techniques, and the like. The volumetric image representations generated by the reconstruction processor 28 are stored in a volumetric image memory 30. A video processor 32 withdraws selective portions of the image memory 30 to create slice images, projection images, surface renderings, and the like, and reformats them for display on a display device 34, such as a video or LCD monitor.

Figure 2:
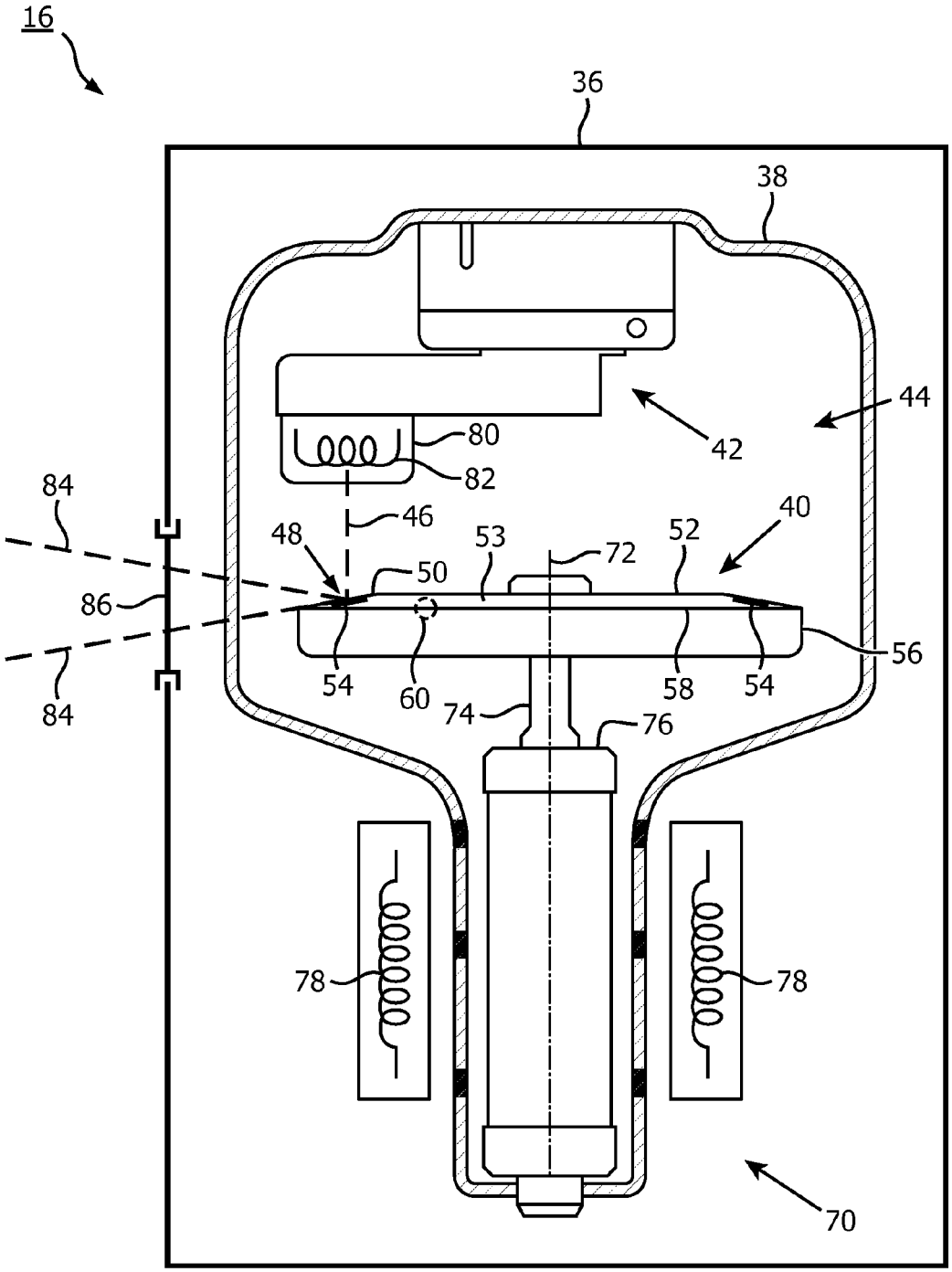
FIG. 2 is a diagrammatic illustration of the x-ray tube assembly of FIG. 1, the x-ray tube assembly including an anode assembly in accordance with aspects of the present disclosure.

With reference to FIG. 2, the x-ray tube assembly 16 includes a housing 36 filled with a heat transfer and electrically insulating cooling fluid, such as oil. More particularly, the cooling fluid is circulated from within the housing 36 through a heat exchanger back to the housing 36 by a pump. X-ray tube assemblies without the use of cooling fluids are also contemplated. The x-ray tube assembly 16 further includes an x-ray tube 38 supported within the housing 36. A rotating anode assembly 40 and a cathode assembly 42 of the x-ray tube 38 are disposed opposing each other within an evacuated chamber 44 of the x-ray tube 38. An electron beam 46 passes from the cathode assembly 42 to a focal spot 48 on an annular, circumferential face 50 of an anode plate 52 of the anode assembly 40.

The anode plate 52 is typically annular in shape and sized depending upon the target application. For example, for CT applications, the anode plate 52 typically includes a diameter of about 8 inches. Further, the anode plate 52 is typically about ¾ of an inch thick. The anode plate 52 includes a substrate 53 of molybdenum alloy, such as a titanium, zirconium, molybdenum (TZM) alloy, with a focal track 54 of a high density tungsten composite or other suitable material for producing x-rays embedded along the annular, circumferential face 50. To dissipate heat, the anode plate 52 is brazed to a piece of graphite 56 using a braze material, such as titanium (Ti), thereby creating a braze joint 58. The piece of graphite 56 is typically brazed to the back of the anode plate 52, but it can be brazed to any other portions of the anode plate 52, such as the top. The piece of graphite 56 is typically annular shaped with a thickness of between a ½ inch and 2 inches. Further, the size of the piece of graphite 56 is typically similar to the anode plate 52. For example, for CT applications, the piece of graphite 56 typically includes a diameter of about 8 inches.

Figure 3:
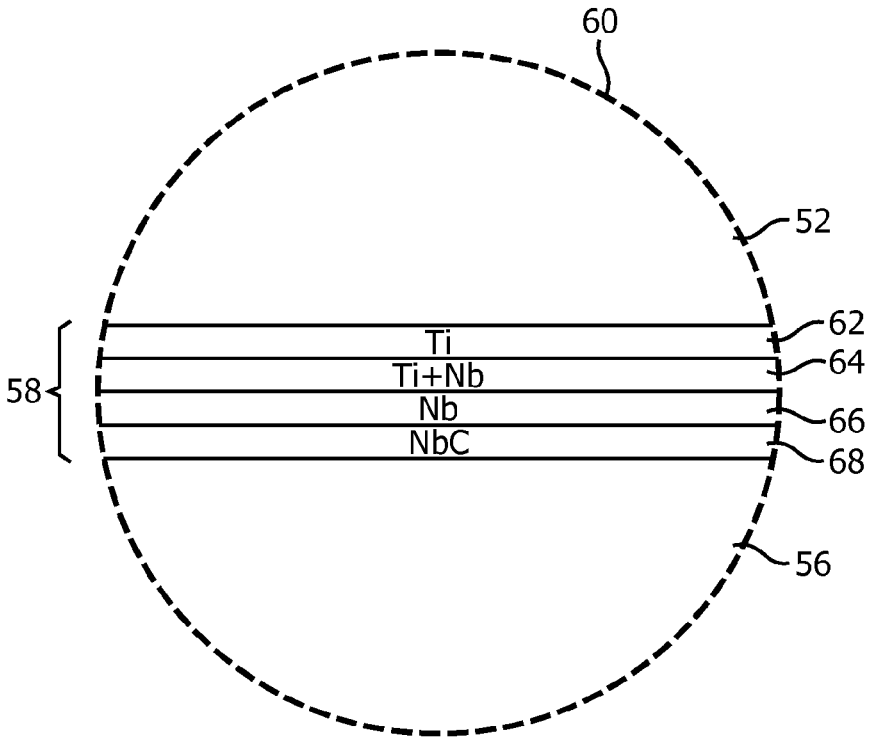
FIG. 3 is an enlarged view of a braze joint of the anode assembly of FIG. 2.
Figure 4:
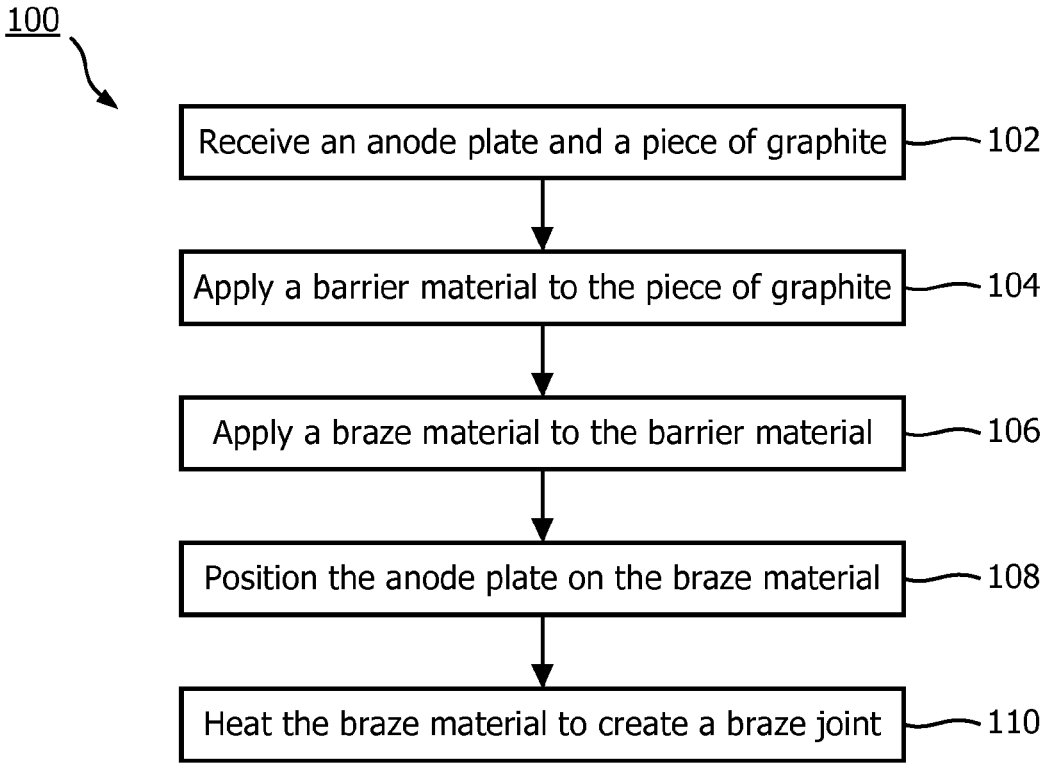
FIG. 4 is a method of manufacturing the anode assembly of FIG. 2.

As noted above, braze joints created using the typical brazing process include a eutectic layer, such as a layer of Ti+TiC, which is an initiation point for cracks. To eliminate the formation of such a eutectic layer, the braze joint 58 includes a barrier material, such as niobium (Nb), between the graphite back 52 and the braze material. With reference to FIG. 3, an enlarged view of a window 60 of the braze joint 58 is illustrated. The braze joint 58 includes a layer 62 comprised of the braze material, an infinite solid solution layer 64 of the barrier material and the braze material, a layer 66 of the barrier material, and a layer 68 comprised of a compound formed from the barrier material and carbon. In contrast with the eutectic layer in the typical braze joint, the infinite solid solution layer 64 does not suffer from void formation while cycling back and forth between the α phase and β phase. The braze material and the barrier material are typically chemical elements.

The anode assembly 40 is mounted to an induction motor assembly 70 for rotation about an anode axis 72. More particularly, the anode assembly 40 is rigidly coupled to a shaft 74 and a rotor 76 of the induction motor assembly 70. The rotor 76 is electromagnetically coupled to drive coils 78 of the induction motor assembly 70 for rotating the shaft 74 and the anode assembly 40 about the anode axis 72.

The cathode assembly 42 is stationary and includes a cathode focusing cup 80 positioned in a spaced relationship with respect to the focal track 54. A cathode filament 82 mounted to the cathode cup 80 is energized to emit the electron beam 46, which is directed to the anode assembly 40, in order to produce x-rays. Electrons of the electron beam 46 are accelerated toward the anode assembly 40 by a large direct current (DC) electrical potential difference between the cathode assembly 42 and the anode assembly 40. In one embodiment, the cathode assembly 42 is at an electrical potential of −100,000 volts with respect to ground, while the anode assembly 40 is at an electrical potential of +100,000 volts with respect to ground, thereby providing a bipolar configuration having a total electrical potential difference of 200,000 volts. Impact of the accelerated electrons of the electron beam 46 onto the focal spot 48 of the anode assembly 40 causes the anode assembly 40 to be heated to a range of between 1100° C. to 1400° C.

Upon striking the focal spot 48, a portion of the electron beam 46 reflects from the focal spot 48 and scatter within the evacuated chamber 44. Electrons which are absorbed, as opposed to reflected, by the anode assembly 40 serve to produce x-rays 84 and heat energy. A portion of the x-rays 84 pass through an x-ray window assembly 86 of the housing 36 towards a subject under examination.

With reference to FIG. 3, a method 100 for creating the braze joint 58 is provided. Advantageously, the braze joint 58 has better application properties than traditional braze joints. The method 100 includes receiving 102 the anode plate 52, including the focal track 54 embedded therein, and the piece of graphite 56. As noted above, both the anode plate 52 and the piece of graphite 56 are typically annular in shape and sized depending upon the application of the anode assembly 40. Further, the anode plate 52 typically includes a thickness of about ¾ of an inch thick, and the piece of graphite 56 typically includes a thickness of between about ½ an inch and 2 inches. Even more, the anode plate 52 and the piece of graphite 56 each include corresponding faces, typically similar in size, to be connected by the braze joint 58.

The barrier material is applied 104, typically with a thickness of about 2/1000 of an inch, to the face of the piece of graphite 56 typically using one of physical vapour deposition (PVD), chemical vapour deposition (CVD), or electrolytic plating. However, other thicknesses and/or approaches for deposition of the barrier material are contemplated. Typically, applying the barrier material to the piece of graphite 52 creates a eutectic layer of the barrier material and a compound comprising the barrier material and carbon (e.g., Nb+NbC) on the piece of graphite 56 prior to heating. The barrier material includes any material, typically an element, with a melting point above the temperature for brazing (e.g., above 1700° C.) and that does not form a brittle carbide once brazed. Examples of barrier materials include Nb, tantalum (Ta), platinum (Pt), and the like. However, barrier materials which dissolve with the braze material to produce a solid solution, such as Nb and Ta, are preferable, since the solid solution is more ductile.

A braze material is applied 106 over the barrier material. As with the barrier material, the braze material is typically an element. Further, the braze material is preferably Ti, since it provides good balance between ductility and melting temperature. As noted above, higher temperatures during brazing decrease the strength of the anode plate. The braze material is typically applied with a thickness of about 4/1000 to 6/1000 of an inch thick, but preferably with a thickness of about 4/1000 to 5/1000 of an inch thick. The braze material can be applied in any form, but is typically applied as a foil or a paste. The face of the anode plate 52 is positioned 108 on the braze material and the braze material and the barrier material are collectively heated 110 above the melting point of the braze material to create the braze joint 58. For Ti, the melting point is about 1600° C. After brazing, the layers 62, 64, 66, 68 of the braze joint 58 are created, as shown in FIG. 3. These layers include the layer 62 of the brazing material, the solid solution layer 64 of the brazing material and the barrier material, the layer 66 of the barrier material, and the layer 68 of the compound comprised of the barrier material and carbon.

Using the method 100 to create the braze joint 58 results in a braze joint less brittle and more ductile than typical braze joints. To illustrate, where Nb and Ti are used as the barrier material and the brazing material, respectively, a layer of NbC, but not TiC, is created. The barrier layer prevents the creation of the TiC layer, which is formed during the typical brazing process. Advantageously, the layer of NbC is less brittle than the layer of TiC and the carbon diffusion rate is lower with the Nb barrier layer, thus eliminating the eutectic Ti+TiC layer, which is an initiation point for cracks.

As used herein, a memory includes one or more of a non-transient computer readable medium; a magnetic disk or other magnetic storage medium; an optical disk or other optical storage medium; a random access memory (RAM), read-only memory (ROM), or other electronic memory device or chip or set of operatively interconnected chips; an Internet/Intranet server from which the stored instructions may be retrieved via the Internet/Intranet or a local area network; or so forth. Further, as used herein, a processor includes one or more of a microprocessor, a microcontroller, a graphic processing unit (GPU), an application-specific integrated circuit (ASIC), a field-programmable gate array (FPGA), and the like; and a display device includes one or more of a LCD display, an LED display, a plasma display, a projection display, a touch screen display, and the like.

The invention has been described with reference to the preferred embodiments. Modifications and alterations may occur to others upon reading and understanding the preceding detailed description. For example, although the present disclosure was described in the context of CT medical imaging, it finds application in other systems using rotating anode x-ray tubes, such as systems used in cardio-vascular medical imaging and systems using x-rays for inspection and security. It is intended that the invention be constructed as including all such modifications and alterations insofar as they come within the scope of the appended claims or the equivalents thereof.

The invention claimed is:

1. A method for creating a braze joint between an anode plate and a piece of graphite of an x-ray tube, said method comprising:

receiving the anode plate and the piece of graphite;

arranging a barrier layer having a thickness of about 2/1000 of an inch and a braze layer having a thickness in a range of 4/1000 to 6/1000 of an inch between the anode plate and the piece of graphite, the barrier layer between the piece of graphite and the braze layer;

and, heating the barrier layer with the braze layer to create the braze joint between the anode plate and the piece of graphite.

2. The method according to claim 1, wherein at least one of the anode plate and the piece of graphite is annular in shape.

3. The method according to claim 1, wherein the anode plate includes a substrate of molybdenum alloy.

4. The method according to claim 3, wherein the anode plate further includes a focal track embedded within the substrate, the focal track formed from a material that produces x-rays when struck by an electron beam.

5. The method according to claim 1, wherein the arranging includes: applying the barrier layer to the piece of graphite; applying the braze layer to the barrier layer; and, positioning the anode plate on the braze layer.

6. The method according to claim 5, wherein the barrier layer is applied to the piece of graphite using one of physical vapor deposition (PVD), chemical vapor deposition (CVD), and electrolytic plating.

7. The method according to claim 1, wherein the barrier layer and the braze layer are arranged between corresponding faces of the anode plate and the piece of graphite to be brazed together.

8. The method according to claim 1, wherein the barrier layer is a material with a melting point above the melting temperature of the braze layer and that does not form a brittle carbide once brazed.

9. The method according to claim 1, wherein the barrier layer is one of niobium (Nb) and tantalum (Ta).

10. The method according to claim 1, wherein the braze layer is titanium (Ti).

11. The method according to claim 1, wherein the barrier layer and the braze layer are heated to the melting temperature of the braze layer.

12. The method according to claim 1, wherein the braze joint includes the braze layer, a solid solution layer of brazing material and barrier material, the barrier layer, and a layer of a compound comprised of the barrier material and carbon.

13. An anode assembly of an x-ray tube comprising:

an anode plate;

a piece of carbon; and, a braze joint between the anode plate and the piece of carbon, the braze joint including a barrier layer having a thickness of about 2/1000 of an inch and a braze layer having a thickness in a range of 4/1000 to 6/1000 of an inch between the anode plate and the piece of carbon, the barrier layer between the piece of carbon and the braze layer.

14. The anode assembly according to claim 13, wherein the braze joint includes the braze layer, a solid solution layer of brazing material and barrier material, the barrier layer, and a layer of a compound comprised of the barrier material and carbon.

15. The anode assembly according to claim 13, wherein the braze layer is titanium (Ti), and the barrier layer is a material with a melting point above the melting temperature of the braze layer and that does not form a brittle carbide once brazed, such as niobium (Nb) and tantalum (Ta).

16. An x-ray tube, comprising: the anode assembly according to claim 13, and, a cathode assembly directing an electron beam to the anode assembly to create x-rays.

17. The anode assembly of claim 13, said piece of carbon comprising a piece of graphite.

18. An anode assembly of an x-ray tube, comprising:

an anode plate;

a piece of carbon; and, between the anode plate and the piece of carbon, a braze joint that includes a braze layer having a thickness in a range of 4/1000 to 6/1000 of an inch and a barrier layer, the barrier layer being disposed between the piece of carbon and the braze layer.

19. The anode assembly of claim 18, said barrier layer being thick enough to prevent carbon from said piece from reaching said braze layer.

20. The anode assembly of claim 18, wherein, between the braze layer and the barrier layer, is a layer comprising a solid solution of barrier material and braze material, the barrier layer being disposed between the piece of carbon and the braze layer.

21. The method of claim 1, further comprising creating, between the braze layer and the barrier layer, via said heating, a layer comprising a solid solution of barrier material and braze material, the barrier layer being disposed between the piece of carbon and the braze layer.

22. The anode assembly of claim 13, wherein, between the braze layer and the barrier layer, is a layer comprising a solid solution of barrier material and braze material, the barrier layer being disposed between the piece of carbon and the braze layer.

* * * * *